US011514744B2

(12) United States Patent
Birulia

(10) Patent No.: US 11,514,744 B2
(45) Date of Patent: Nov. 29, 2022

(54) COIN SORTING APPARATUS

(71) Applicant: Cassida Corporation, San Diego, CA (US)

(72) Inventor: Matvey Birulia, San Diego, CA (US)

(73) Assignee: Cassida Corporation, San Diego, CA (US)

( * ) Notice: Subject to any disclaimer, the term of this patent is extended or adjusted under 35 U.S.C. 154(b) by 146 days.

(21) Appl. No.: 16/749,599

(22) Filed: Jan. 22, 2020

(65) Prior Publication Data

US 2021/0225110 A1 Jul. 22, 2021

(51) Int. Cl.
*G07D 3/08* (2006.01)
*G07D 9/06* (2006.01)

(52) U.S. Cl.
CPC ..... *G07D 3/08* (2013.01); *G07D 9/065* (2013.01)

(58) Field of Classification Search
CPC ..... G07D 3/08; G07D 9/065
See application file for complete search history.

(56) References Cited

U.S. PATENT DOCUMENTS

| | | | | |
|---|---|---|---|---|
| 4,940,162 | A | 7/1990 | Thie | |
| 5,557,908 | A * | 9/1996 | Ozeki | G07D 3/16 53/212 |
| 6,099,401 | A * | 8/2000 | Perkitny | G07D 9/065 453/9 |
| 6,443,829 | B1 * | 9/2002 | Perkitny | G07D 3/08 453/9 |
| 6,733,380 | B1 * | 5/2004 | Kohls | G07D 3/128 453/31 |
| 7,712,597 | B2 * | 5/2010 | Frost | G07D 3/14 194/346 |
| 8,684,160 | B2 | 4/2014 | Hallowell et al. | |
| 8,701,860 | B1 * | 4/2014 | Blake | B65B 67/1238 194/350 |
| 2008/0083194 | A1 * | 4/2008 | Kasahara | G07D 9/065 53/52 |
| 2010/0121485 | A1 * | 5/2010 | Hosoda | G07D 9/065 700/223 |
| 2013/0183892 | A1 * | 7/2013 | Pierce | G07D 5/00 453/3 |
| 2015/0041593 | A1 * | 2/2015 | Markov | B64D 1/02 244/137.1 |

* cited by examiner

*Primary Examiner* — Thien M Le
*Assistant Examiner* — Asifa Habib
(74) *Attorney, Agent, or Firm* — McCoy Russell LLP

(57) ABSTRACT

Methods and systems are provided for a coin sorting apparatus. In one example, a coin sorting apparatus is configured to receive a coin wrapper without moving a coin tube.

12 Claims, 10 Drawing Sheets

COIN SORTING APPARATUS

FIELD

The present description relates generally to a coin sorting apparatus configured to dispense rolled coins into a coin wrapper.

BACKGROUND/SUMMARY

A coin sorting machine may sort and dispense coins of a shared value into a coin wrapper. The coin wrapper may be held via a coin tube and/or a coin attachment. Once the coin wrapper is filled with a plurality of coins, the coin wrapper may be replaced with an empty coin wrapper via removal of the filled coin wrapper and its corresponding coin tube and/or coin attachment.

One example approach is shown by Perkitny et al. in U.S. Pat. No. 6,443,829. Therein, a coin sorting apparatus comprises a hopper into which a plurality of unsorted coins is deposited. The coins are sorted within the coin sorting apparatus via a ramp comprising a plurality of openings with a plurality of diameters, wherein diameters of the plurality of diameters are equal to various diameters of different coins, such as pennies, nickels, dimes, quarters, and one dollar coins. Coins may fall through openings and deposited onto one of a plurality of chutes. A plurality of coin wrappers is positioned adjacent to respective lower edges of one chute of the plurality of chutes. The wrappers are supported at their open upper ends via a collar assembly and at their lower constricted end via a base assembly. Coins may fall from the chutes and fill corresponding coin wrappers.

However, the inventors have identified some issues with the approaches described above. For example, the base assembly is pressed through the lower constricted end and the open upper end is then arranged at or slightly below the lower edge of a corresponding chute via the collar to allow a coin to fall at a desired orientation to fill the coin wrapper. This process is time-consuming. To remove a filled coin wrapper, an operator presses a first finger against the constricted end to lift the filled coin wrapper through the collar. The operator then uses a second finger to press against the open end to block coins from escaping the coin wrapper due to the force applied by their first finger.

Other examples of coin sorter and wrapper supports include a coin tube and/or coin attachment for coin wrappers. Once the coin wrapper is filled, the coin tube and/or coin attachment is removed to replace the filled coin wrapper with an empty coin wrapper. This process is also time consuming and aligning the coin wrapper with the coin tube and/or coin attachment may be difficult due to the flexible nature of the coin wrapper. Furthermore, removal of the filled coin wrapper from the coin tube and/or the coin attachment may be difficult due to the rigidity of the filled coin wrapper.

In one example, the issues described above may be addressed by a system comprising a coin sorting apparatus configured to receive a coin wrapper without moving a coin tube. In this way, the coin tube may be stationary as a filled coin wrapper is replaced with an empty coin wrapper or as an empty coin wrapper is positioned onto the stationary coin tube.

As one example, a plurality of coin tube platforms may interface with a plurality of corresponding coin tubes, wherein the coin tube platforms and coin tubes may be matched based on a corresponding coin denomination. Each coin tube may comprise a cylindrical shape with a diameter associated with a specific coin denomination. The coin tube may be open along its half facing an exterior of the coin sorting apparatus. In one example, the coin tube is open along its longitudinal length (e.g., a height of the cylinder) and open at its top and bottom. The coin wrapper may be positioned within the opening of the coin tube to receive coins. Once the coin wrapper is filled, the coin wrapper may be removed from the coin tube without moving the coin tube. As such, the coin tube may remain stationary and positioned within the coin sorting apparatus as a coin wrapper is loaded and removed. By doing this, an efficiency of sorting coins into corresponding coin wrappers may be increased relative to the previous examples described above.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 1-12 are shown to scale, however, other relative dimensions may be used if desired.

DETAILED DESCRIPTION

The following description relates to systems and methods for a coin sorting apparatus. The coin sorting apparatus, such as the coin sorting apparatus illustrated in FIG. 1, comprises a plurality of slots configured to receive a plurality of coins. More specifically, each slot may receive a coin of a single denomination. For example, a first slot may correspond to a penny, a second slot may correspond to a nickel, a third slot may correspond to a dime, a fourth slot may correspond to a quarter, and a fifth slot may correspond to a dollar coin. It will be appreciated that the slots may be adjusted to deposit international coins and are not limited to U.S. currency.

Figure 2:
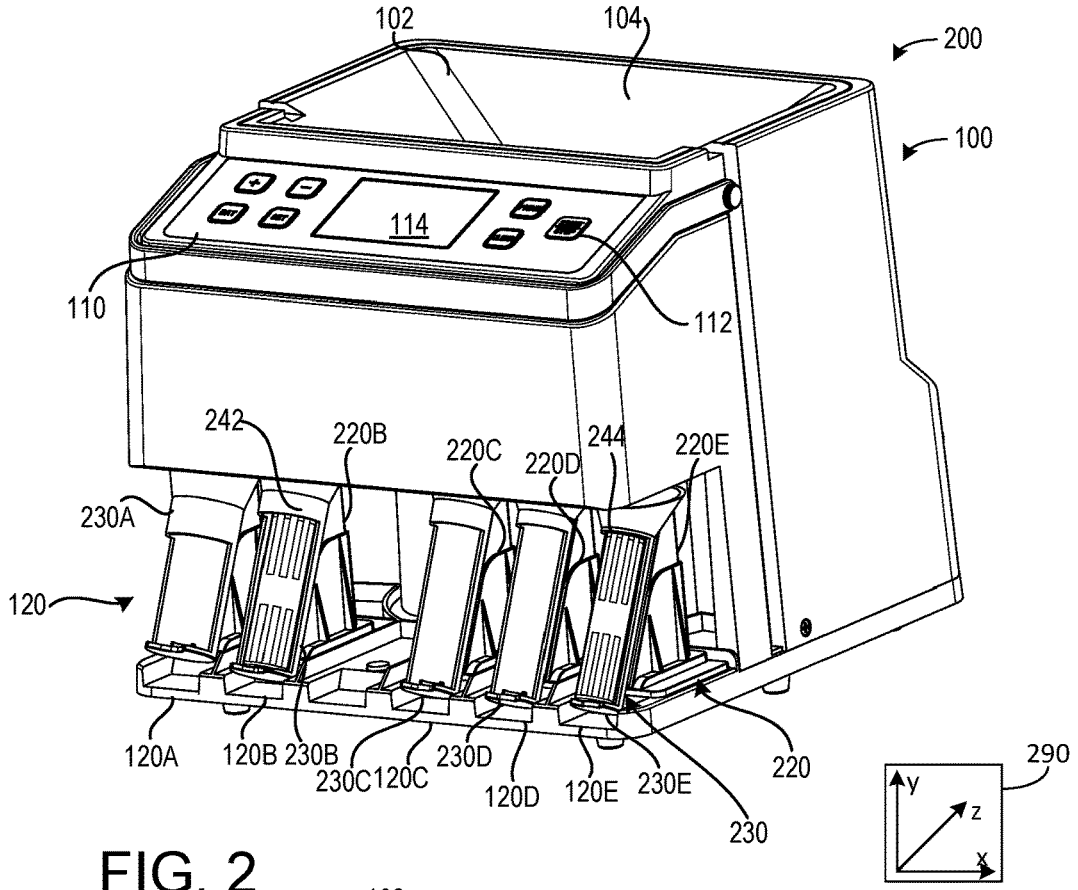
FIG. 2 illustrates a view of a coin sorting apparatus with dispensing slots configured to receive coin wrappers.
Figure 3:
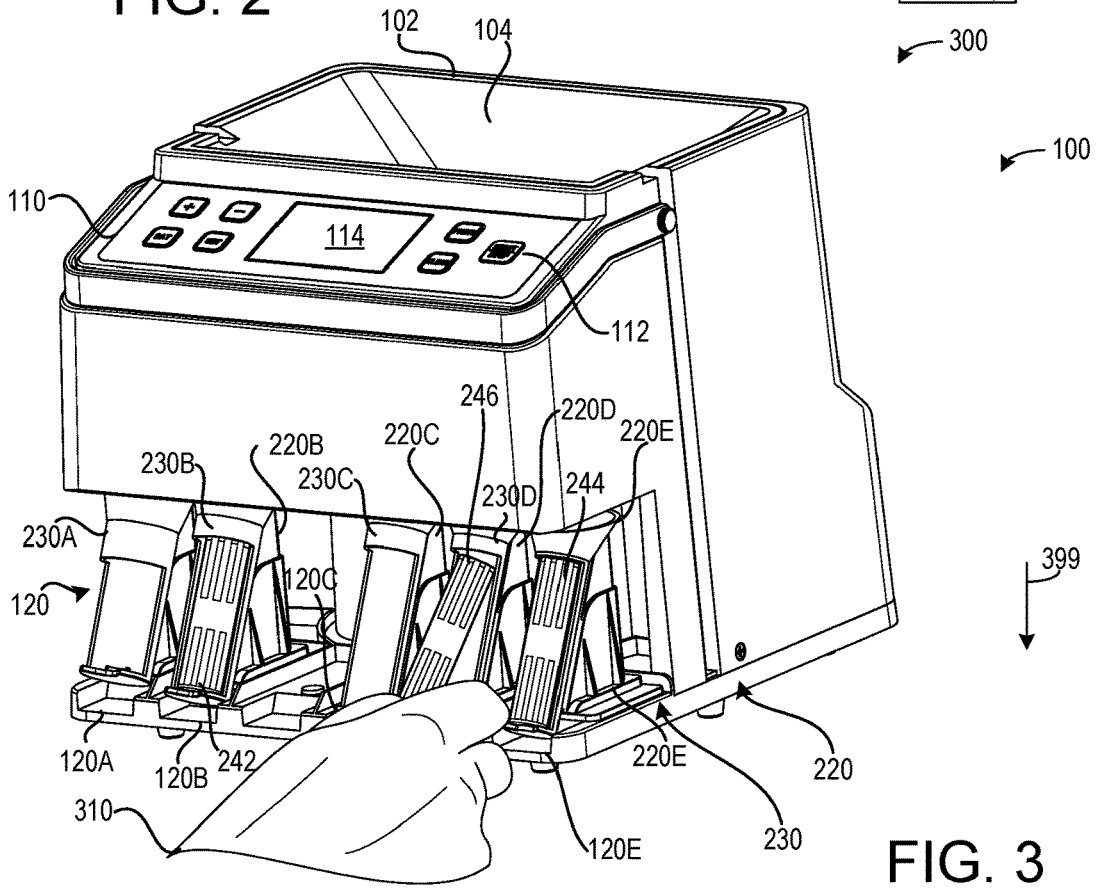
FIG. 3 illustrates a coin wrapper being positioned into a corresponding slot.
Figure 4:
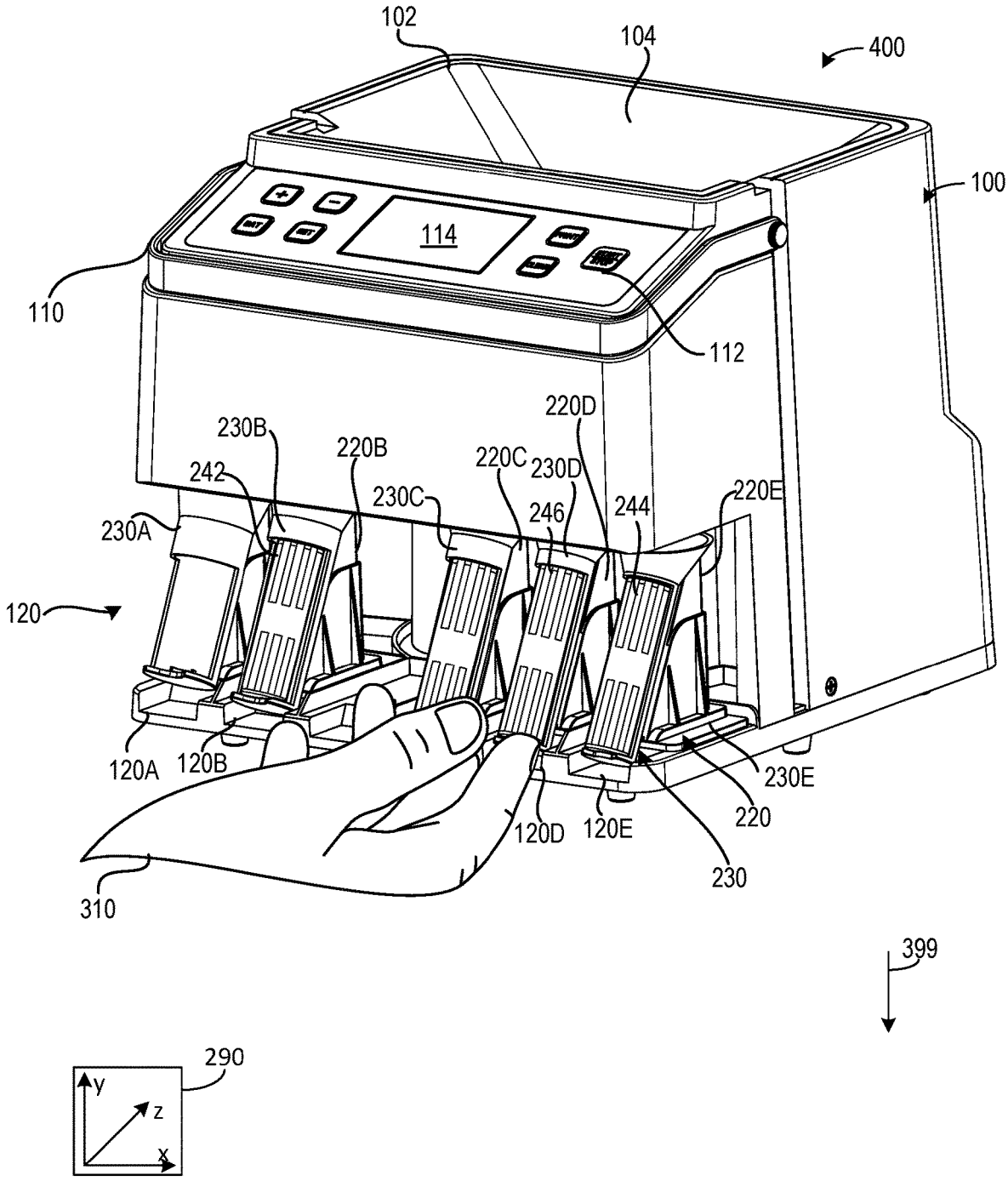
FIG. 4 illustrates the coin wrapper being removed from the corresponding slot.

Each slot may comprise a coin tube platform on which a coin tube is arranged, as illustrated in FIG. 2. The coin tube may be configured to receive a coin wrapper, as illustrated in FIG. 3. The coin wrapper may be removed from the coin tube, for example, in response to the coin wrapper being filled with coins, as illustrated in FIG. 4.

Figure 5:
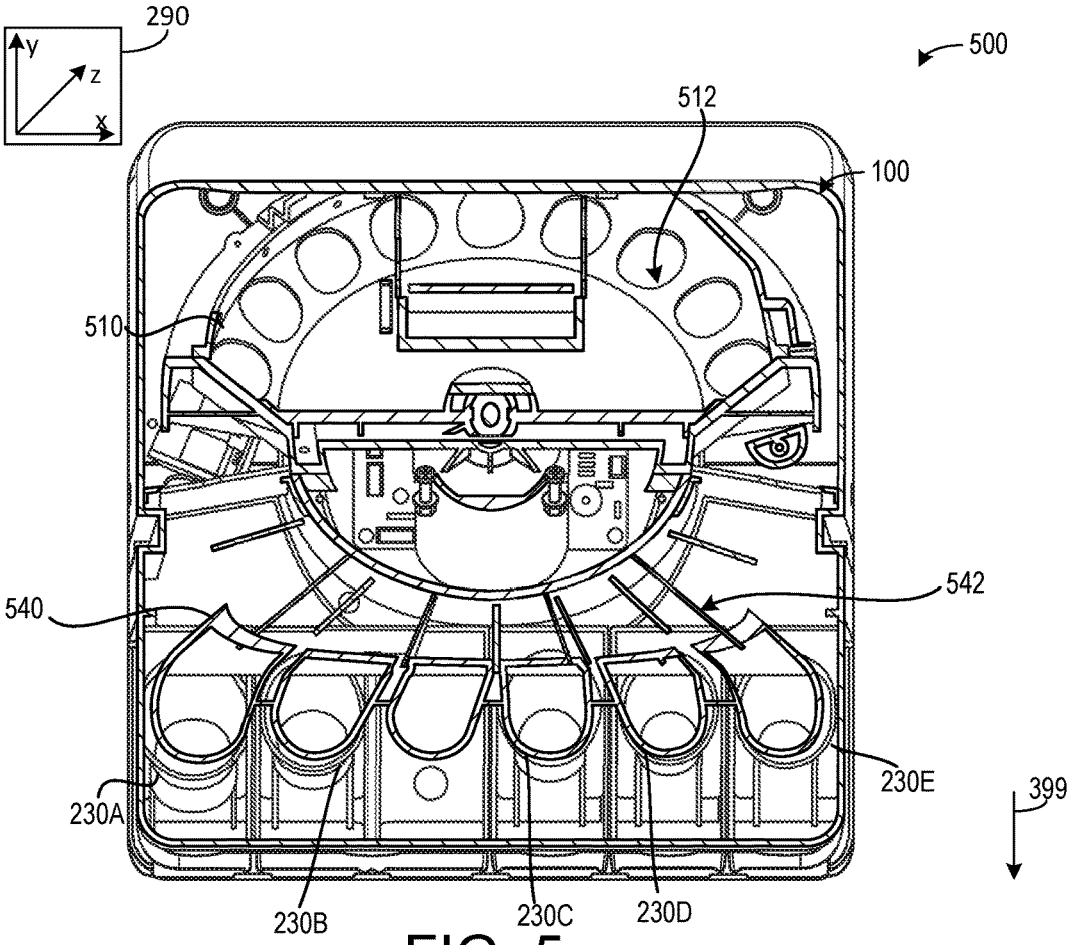
FIG. 5 illustrates a coin dispensing manifold engaged with a coin sorter and a plurality of slots.
Figure 6:
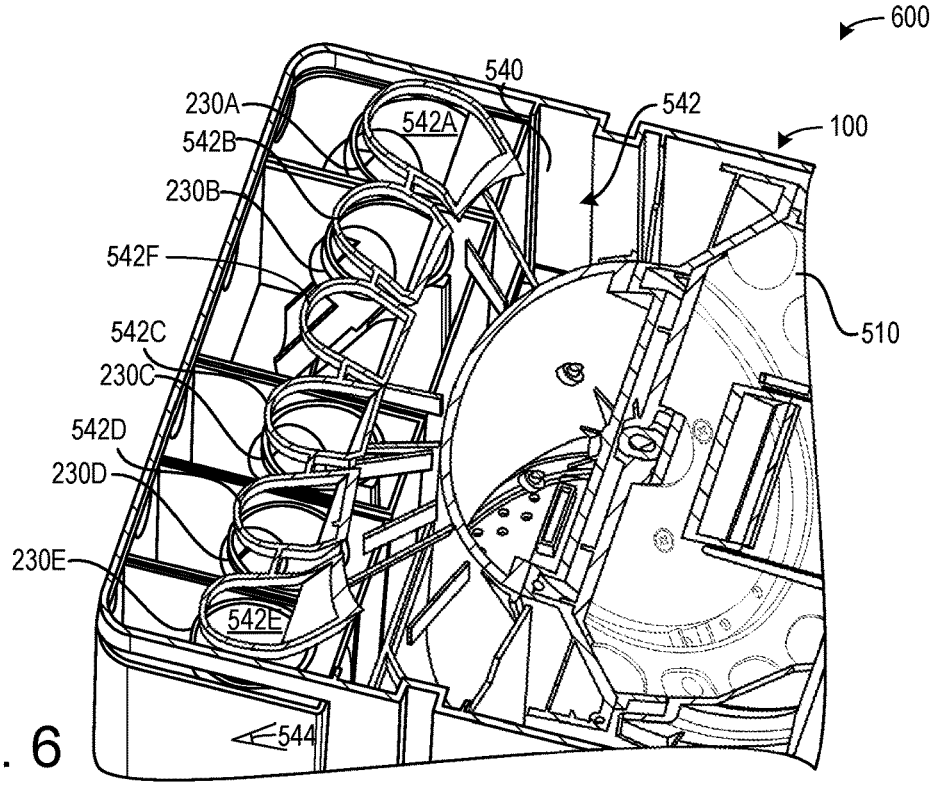
FIG. 6 illustrates a further view of the coin dispensing manifold arranged above the plurality of slots.
Figure 7:
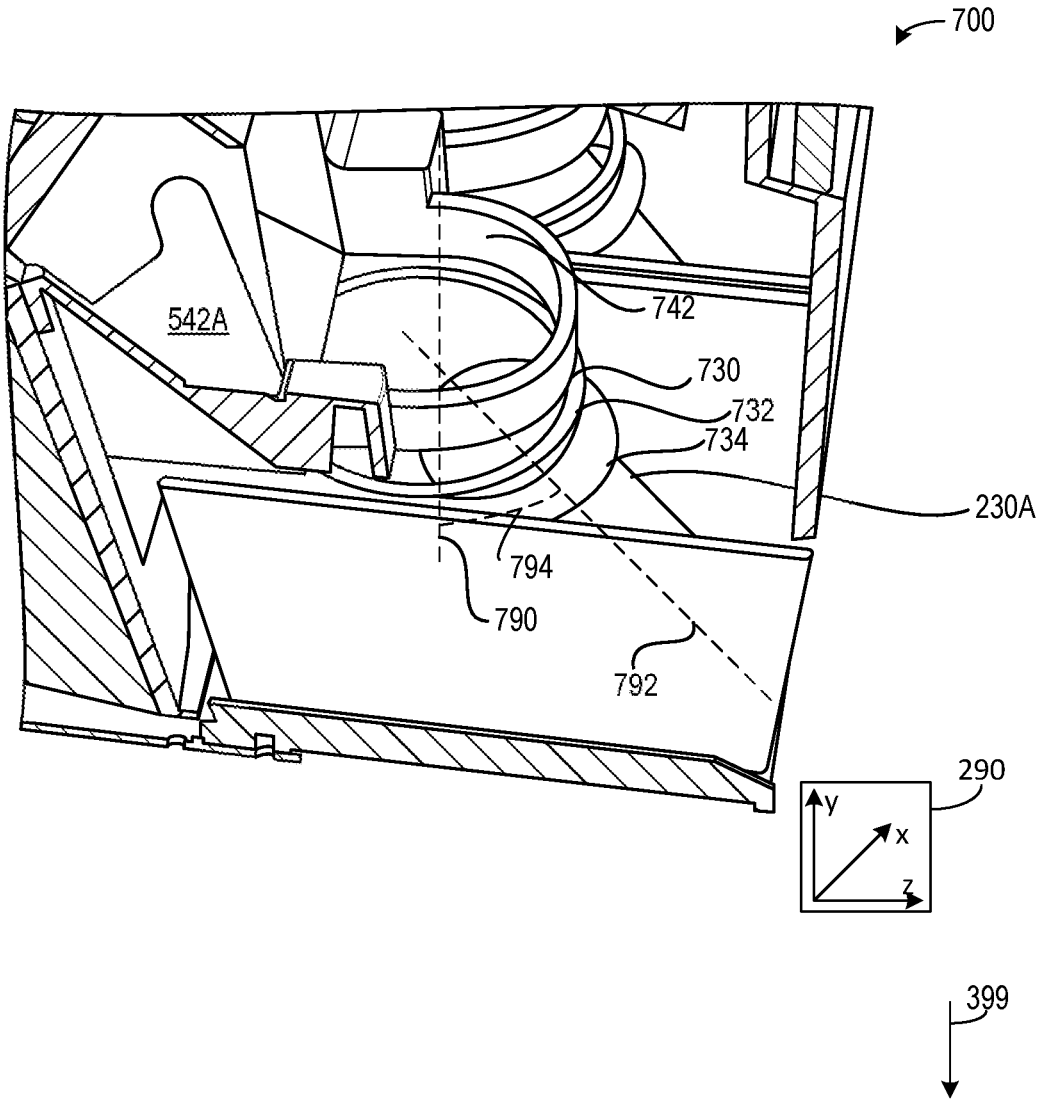
FIG. 7 illustrates a spacing between a coin tube and an outlet of the coin dispensing manifold.

A coin dispensing manifold may distribute coins from a coin sorter of the coin sorting apparatus to corresponding slots of the plurality of slots. The coin dispensing manifold is illustrated in FIGS. 5 and 6. FIG. 7 illustrates a spacing between a corresponding coin tube and a corresponding outlet of the coin dispensing manifold.

Figure 8A:
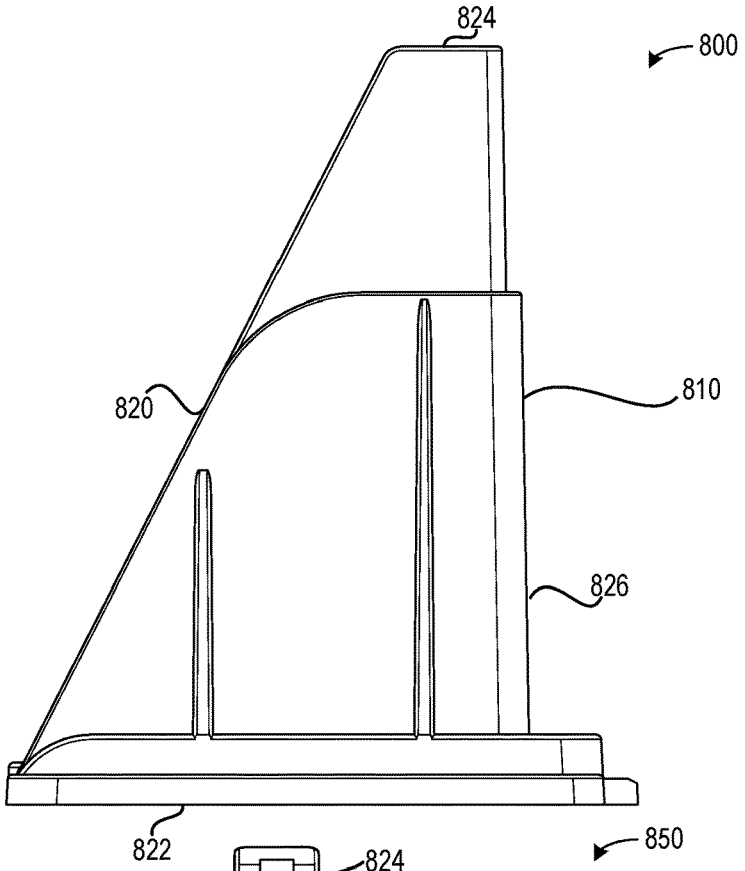
FIG. 8A illustrates a side-on view of a coin tube platform.
Figure 8B:
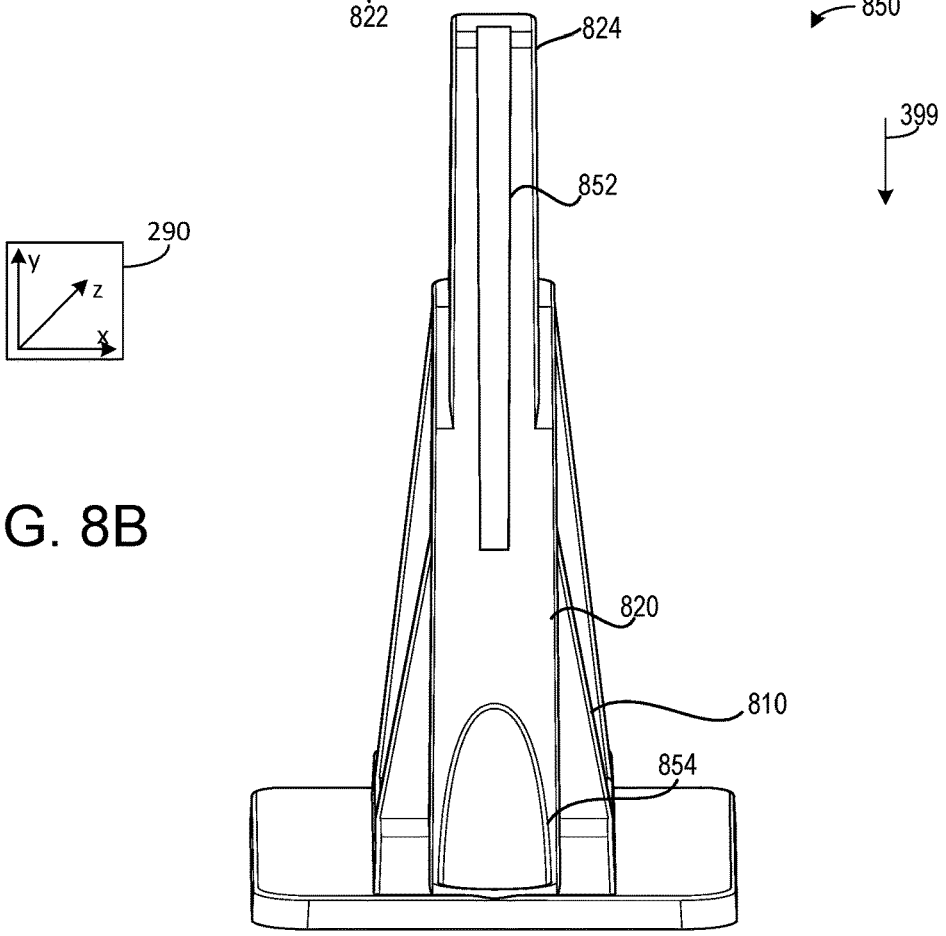
FIG. 8B illustrates a face-on view of the coin tube platform.
Figure 9A:
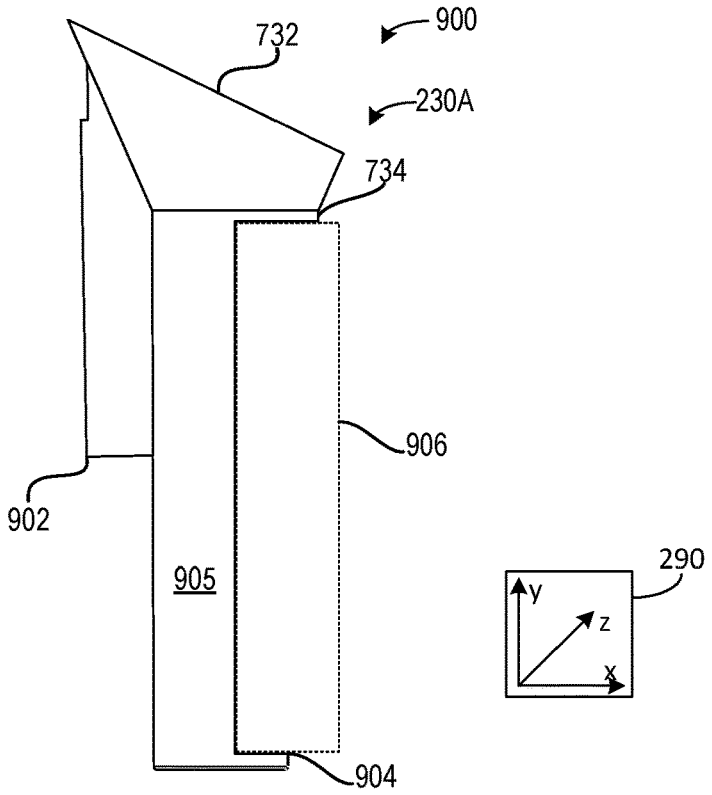
FIG. 9A illustrates a side-on view of the coin tube.
Figure 9B:
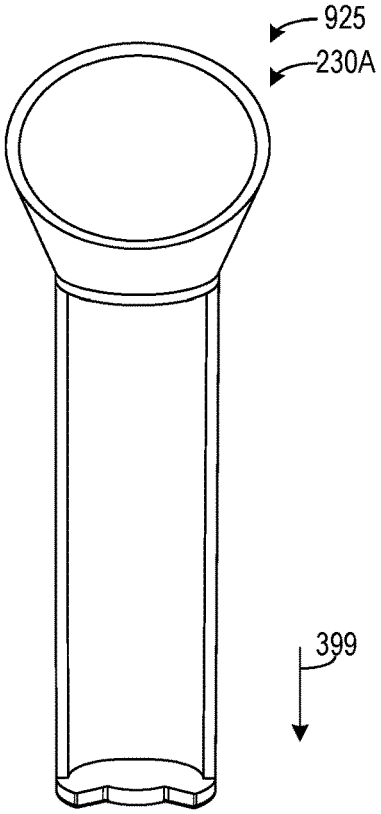
FIG. 9B illustrates a face-on view of the coin tube.
Figure 9C:
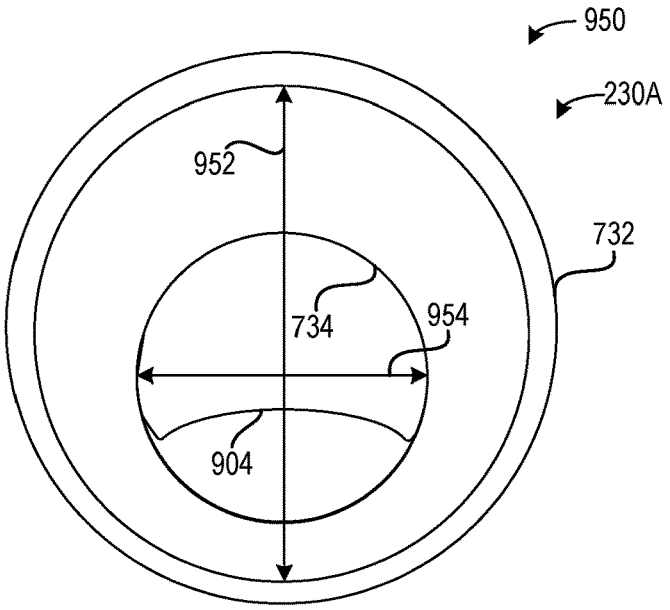
FIG. 9C illustrates a top-down view of the coin tube.

The coin tube is arranged on the coin tube platform, wherein a shape of the coin tube platform is illustrated in FIGS. 8A and 8B. The coin tube may comprise a complementary shape to the coin tube platform, wherein the shapes may block movement of the coin tube relative to the coin tube platform in response to the coin wrapper being removed or positioned onto the coin tube. A shape of the coin tube is illustrated in FIGS. 9A, 9B, and 9C.

Figure 10:
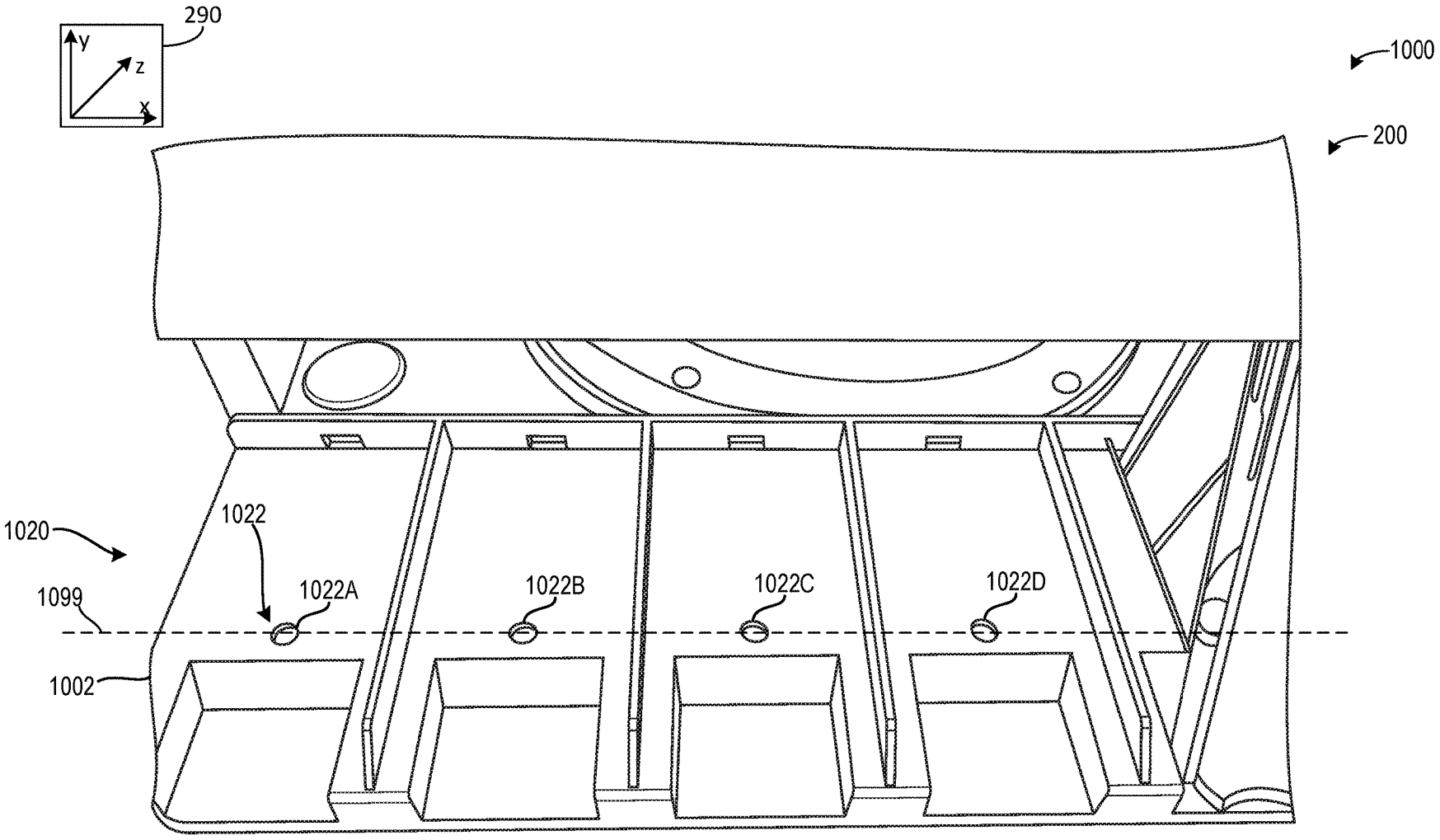
FIG. 10 illustrates an embodiment of the coin sorting apparatus comprising a plurality of magnets.
Figure 11:
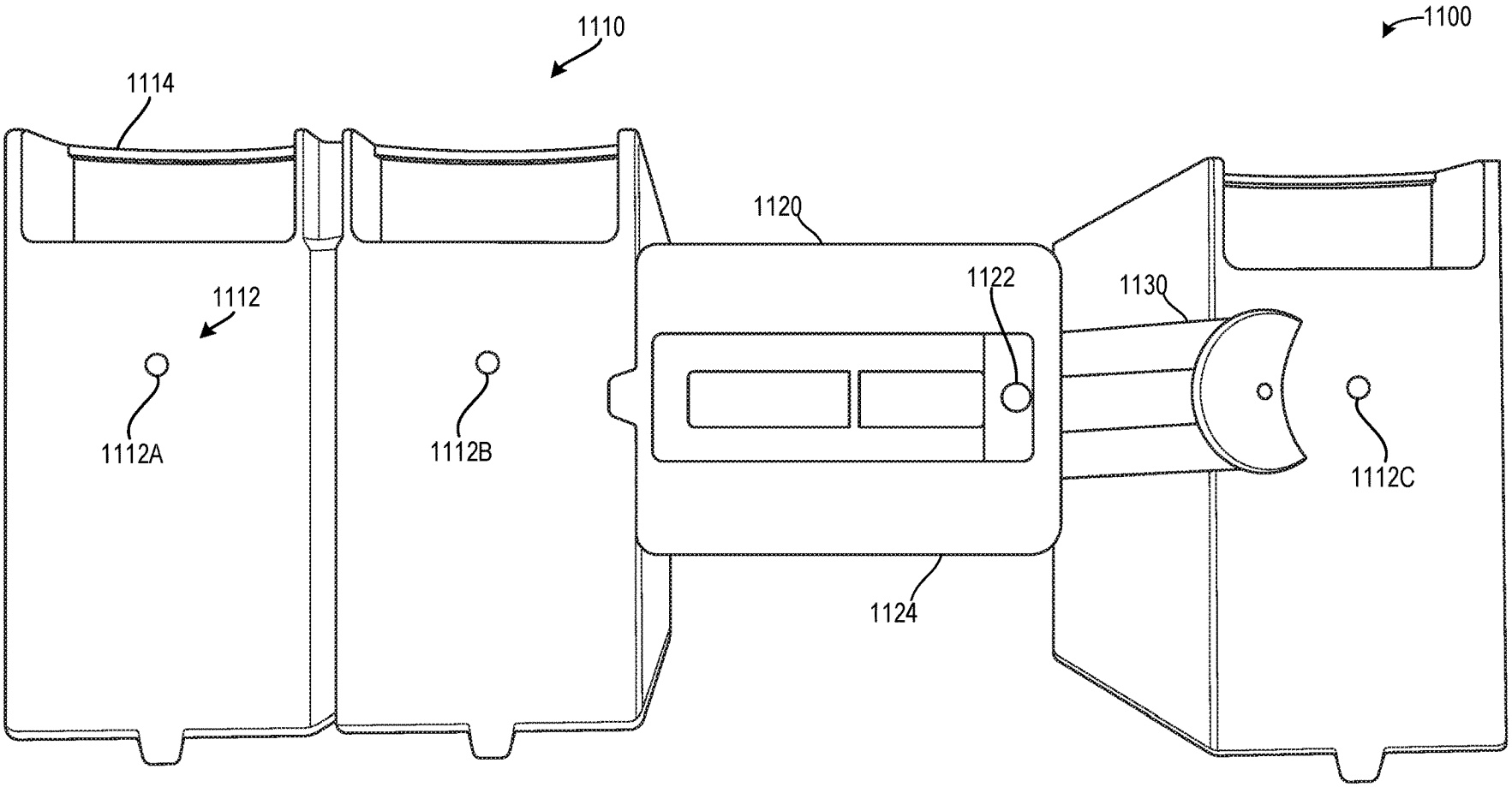
FIG. 11 illustrates a first view of a plurality of coin bins and the coin tube comprising magnets.
Figure 12:
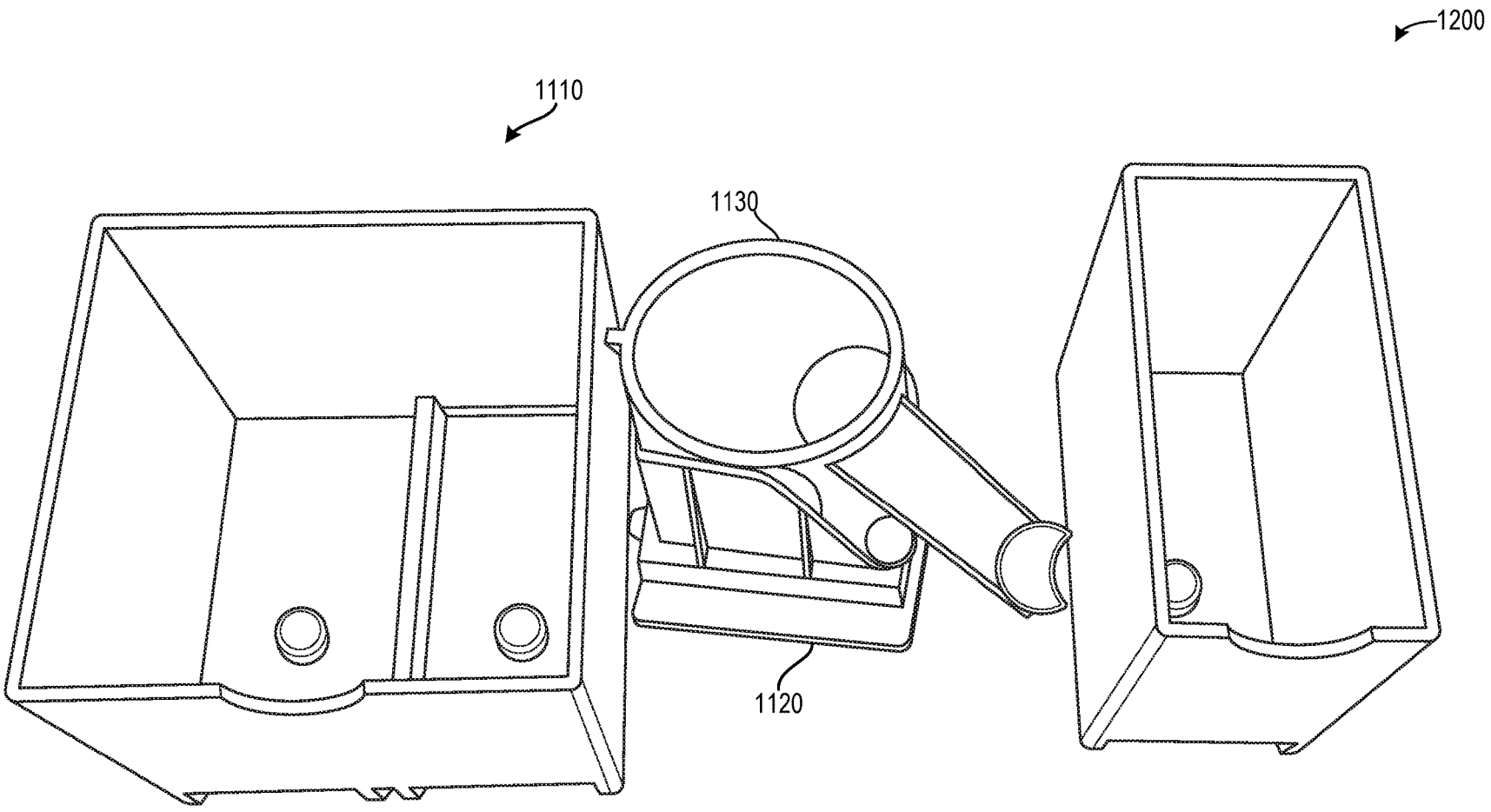
FIG. 12 illustrates a second view of the plurality of coin bins and the coin tube comprising magnets.

The coin sorting apparatus may comprise a plurality of magnets. In one example, the plurality of magnets may be alignment and/or positioning magnets used to desirably position the coin tubes and/or the coin bins. The coin sorting apparatus comprises a plurality of magnets positioned on a base, as illustrated in FIG. 10. Magnets of the coin tubes and of coin bins are illustrated in FIGS. 11 and 12. The magnets of the coin tubes and/or coin bins may engage with magnets of the base of the coin sorting apparatus such that the coin tubes and/or coin bins are desirably positioned to receive coins from an outlet manifold of the coin sorting apparatus.

Additionally or alternatively, a plurality of mechanical fasteners may be used to desirably position the coin tubes and/or the coin bins. The plurality of mechanical fasteners may slide into and/or engage with a locked position and retain the coin tubes and/or coin bins in a desired location.

The present disclosure may at least partially solve the issues described above associated with previous examples of coin sorting devices by allowing an operator to arrange a coin wrapper onto a coin tube without removing the coin tube from the coin sorting apparatus or its corresponding slot. As such, a coin sorting procedure may be expedited via only needing to move the coin wrapper and not the coin tube.

FIGS. 1-12 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Figure 1:
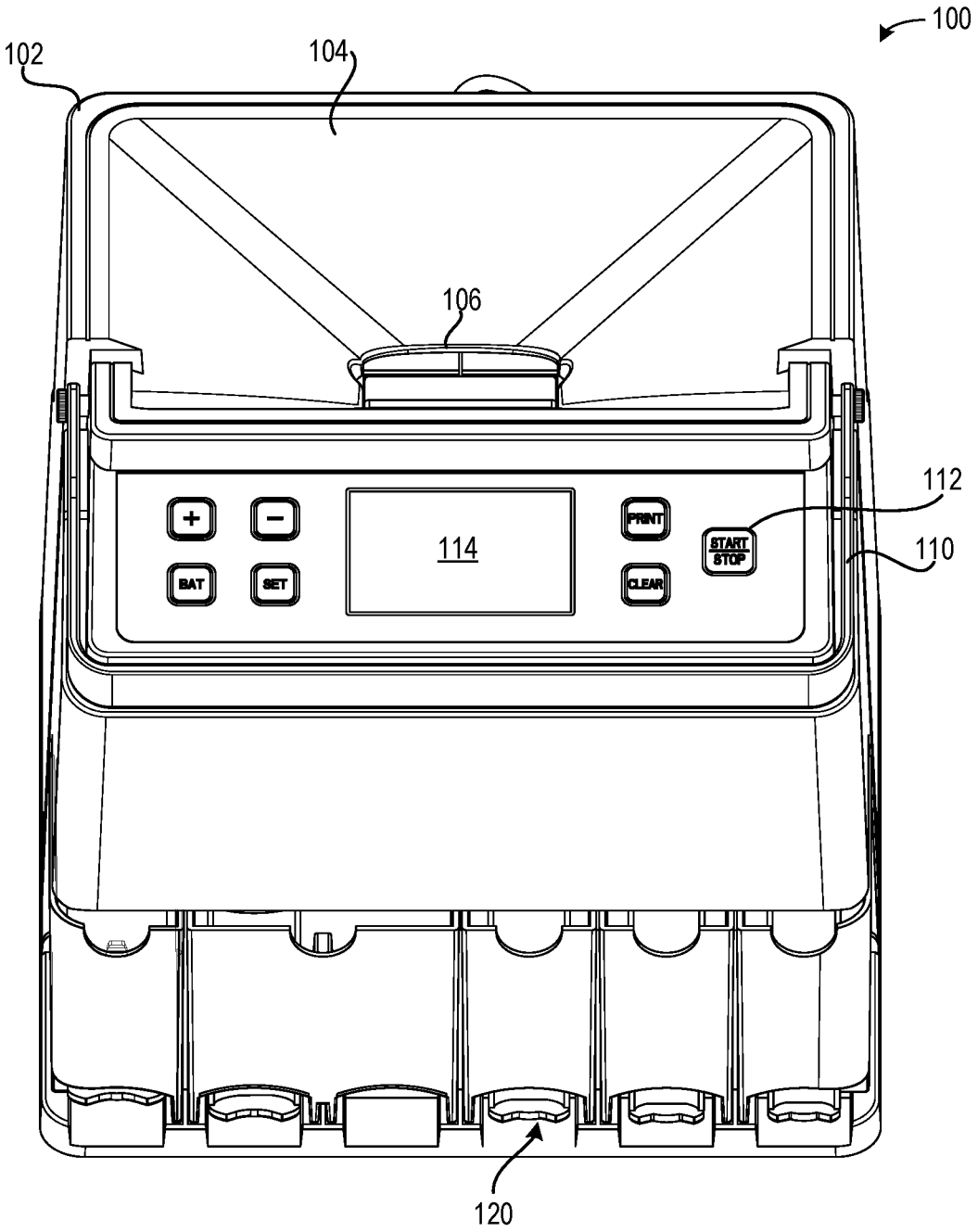
FIG. 1 illustrates a view of a coin sorting apparatus.

Turning now to FIG. 1, it shows a coin sorting apparatus 100. A body 102 comprises a cubical shape, however, other three-dimensional shapes such as a rectangular prism, a cylinder, and the like. A hopper 104 is arranged at a top of the body 102 with a slot 106 configured to deposit coins into an interior space of the coin sorting apparatus 100.

A user interface 110 may be arranged on a surface of the body 102. The user interface 110 may comprise a plurality of buttons 112 for adjusting an operation of the coin sorting apparatus. In one example, depression of one or more of the buttons may send a signal to a controller with instructions stored in non-transitory memory thereof that enable the controller to activate/deactivate the coin sorting apparatus, increase/decrease a sorting speed, adjust a denomination coins being sort, and the like when a corresponding button is depressed. The user interface 110 may further comprise a screen 114. The screen 114 may display various details to an operator, such as a coin count, denomination being sorted, speed, a total value of coins deposited into coin wrappers, and the like. The coin count may correspond to one or more a number of coins deposited through the hopper 104, a number of coins deposited into coin sleeves, and the like. In this way, the coin sorting apparatus 100 may also be configured to count coins in addition to sorting coins, wherein the counting may include where coins of different denominations are counted separately from one another.

A plurality of slots 120 are arranged in a lower portion of the coin sorting apparatus. Relative to gravity 199, the plurality of slots 120 are arranged below the hopper 104 and the slot 106. As such, coins may be sorted within the coin sorting apparatus at a location above the plurality of slots 120 such that sorted coins may fall into coin wrappers arranged in the plurality of coin slots 120.

In the example of FIG. 1, the plurality of slots 120 comprise a cover 122, which wraps around and covers the plurality of slots 120. In one example, the cover 122 may be optional. Additionally or alternatively, the cover 122 may be removable such that during operation of the coin sorting apparatus 100, the cover 122 is removed and the plurality of slots 120 are revealed.

Turning now to FIGS. 2-4, they show a coin wrapper being loaded into a slot of the plurality of slots 120. In the example of FIGS. 2-4, the coin wrapper is arranged into the slot to receive a plurality of coins and then removed from the slot once the coin wrapper is filled with a threshold number of coins (e.g., 10 or more, 20 or more, 50 or more coins).

FIG. 2 shows an embodiment 200 of the coin sorting apparatus 100, wherein only two coin wrappers are arranged within the plurality of slots 120. More specifically, the plurality of slots comprises a first slot 120A, a second slot 120B, a third slot 120C, a fourth slot 120D, and a fifth slot 120E. Each of the plurality of slots 120 may be configured to receive different coin wrapper denominations. A coin tube of a plurality of coin tubes 230 may determine which coin wrapper denomination each slot may receive. The plurality of coin tubes 230 may comprise a first coin tube 230A, a second coin tube 230B, a third coin tube 230C, a fourth coin tube 230D, and a fifth coin tube 230E. The first coin tube 230A may be arranged in the first slot 120A. The second coin tube 230B may be arranged in the second slot 120B. The third coin tube 230C may be arranged in the third slot 120C. The fourth coin tube 230D may be arranged in the fourth slot 120D. The fifth coin tube 230E may be arranged in the fifth slot 120E.

A plurality of mounts 220 may be configured to receive the plurality of coin tubes 230. The plurality of mounts 220 includes a first mount 220A, a second mount 220B, a third mount 220C, a fourth mount 220D, and a fifth mount 220E. The first mount 220A may be arranged in the first slot 120A and receive the first coin tube 230A. The second mount 220B may be arranged in the second slot 120B and receive the second coin tube 230B. The third mount 220C may be arranged in the third slot 120C and receive the third coin tube 230C. The fourth mount 220D may be arranged in the fourth slot 120D and receive the fourth coin tube 230D. The fifth mount 220E may be arranged in the fifth slot 120E and receive the fifth coin tube 230E.

In the embodiment of FIG. 2, a first coin wrapper 242 is arranged in the second slot 120B and a second coin wrapper 244 is arranged in the fifth slot 120E. The first slot 120A, the third slot 120C, and the fourth slot 120D are empty and free of coin wrappers. In one example, the coin wrappers may be pre-cut and shaped to hold a specific amount of coins for each denomination. In some examples, coin wrappers of different denominations may hold different numbers of coins. Additionally or alternatively, each coin wrapper, independent of denomination, may hold an identical number of coins.

Turning now to FIG. 3, it illustrates an embodiment 300 of the coin sorting apparatus 100 wherein a third coin wrapper 246 is being arranged into the fourth slot 120D. As shown, the third coin wrapper 246 is arranged onto the fourth coin tube 230D without moving the fourth coin tube 230D. Said another way, the fourth coin tube 230D remains engaged with the fourth mount 220D within the fourth slot 120D as the third coin wrapper 246 is arranged onto the fourth coin tube 230D.

In one example, the operator 310 presses the third coin wrapper 246 upward, in a direction opposite gravity 399 until a bottom portion of the third coin wrapper 246 is above a bottom portion of the fourth coin tube 220D. Once this has occurred, the operator 310 pushes the third coin wrapper 246 in a direction perpendicular to gravity 399 toward the fourth coin tube 220D such that the third coin wrapper 246 remains arranged on the fourth coin tube 220D without assistance from the operator 310, similar to the first coin wrapper 242 and the second coin wrapper 244.

Turning now to FIG. 4, it shows an embodiment 400 of the coin sorting apparatus 100, wherein the third coin wrapper 246 is being removed from the fourth slot 120D. The third coin wrapper 246 may be pressed upward in a direction parallel to an angle of the fourth slot 120D. Once the bottom portion of third coin wrapper 246 is above the bottom portion of the fourth coin tube 230D, the coin wrapper 246 may be pulled in a direction perpendicular to gravity 399 and out of the fourth slot 120D. As such, the fourth coin tube 230D remains completely stationary and is not removed from the fourth slot 120D as the third coin wrapper 246 is removed.

In this way, the coin tube is stationary as the coin wrapper is positioned thereon or removed therefrom. The coin tube comprises a longitudinal portion (e.g., a longitudinal half) cutout therefrom such that the coin wrapper may be readily positioned therein or removed therefrom. The coin tube may surround only a portion of the coin wrapper, as illustrated. In one example, the coin tube may surround half or less of the coin wrapper. Additionally or alternatively, the coin tube may surround a third or less of the coin wrapper. As such, a diameter of the coin wrapper may be less than a diameter of the coin tube. Furthermore, surfaces of the coin wrapper may be in face-sharing contact with surfaces of the coin tube. However, both the coin tube and the coin wrapper may be free of surface features engaging one another. That is to say, outside of the surfaces of the coin tube and coin wrapper contacting one another, there are no other features holding the coin wrapper onto the coin tube.

Turning now to FIGS. 5 and 6, they show views 500 and 600 of an internal compartment of the coin sorting apparatus 100, respectively. The coin sorting apparatus 100 comprises both a disc 510 and an outlet manifold 540. The disc 510 may gather coins from a hopper, such as hopper 104 of FIG. 1. The disc may comprise a plurality of pockets 512 into which coins may gather. The disc 510 may be rotated via a motor, such as an electric motor, and deliver the coins to corresponding channels 542 of the outlet manifold 540. In one example, a sizing of the plurality of pockets 512 and the channels 542 may allow both components to be selective as to which denomination of coin is arranged therein. As such, an associated pocket and channel may be sized similarly such that each receives the same denomination of coin without receiving other denominations of coins. Additionally or alternatively, the selectivity may be based on a magnetic property of the coins.

The disc 510 may feed coins into the plurality of channels 542 which may then distribute the coins to the plurality of coin tubes 230. In one example, the disc 510 may be mounted at an angle, as shown in FIG. 6. An amount of the angle may be less than 30 degrees. In one example, the angle may be less than 20 degrees. In another example, additionally or alternatively, the angle may be less than 10 degrees. In another example, the angle may be less than 5 degrees.

The outlet manifold 540 and the plurality of channels 542 may also be mounted at an angle complementary to the angle of the disc 510. For example, the angle of the disc 510 is such that coins on the disc 510 rise in elevation while the angle of the plurality of channels 542 is such that the coins decrease in elevation as they pass through the plurality of channels 542. Herein, the angle of the plurality of channels 542 is referred to as angle 544. The angle 544 may be less than 40 degrees. Additionally or alternatively, the angle 544 may be less than 30 degrees. Additionally or alternatively, the angle 544 may be less than 20 degrees. Additionally or alternatively, the angle 544 may be less than 10 degrees.

The plurality of channels 542 may comprise a first channel 542A, a second channel 542B, a third channel 542C, a fourth channel 542D, a fifth channel 542E, and a sixth channel 542F. The first channel 542A may be configured to dispense coins to the first coin tube 230A. The second channel 542B may be configured to dispense coins to the second coin tube 230B. The third channel 542C may be configured to dispense coins to the third coin tube 230C. The fourth channel 542D may be configured to dispense coins to the fourth coin tube 240D. The fifth channel 542E may be configured to dispense coins to the fifth coin tube 240E. The sixth channel 542F is positioned above an empty slot of the plurality of slots (e.g., plurality of slots 120 of FIG. 1). In the present example, the sixth channel 542F may not receive nor dispense coins. However, those of ordinary skill in the art will appreciate that the sixth channel 542F may be utilized for currencies with greater than five coins.

The plurality of channels 542 may be similarly shaped, however, the sizes may vary due to a distance between an inlet of a channel and an inlet of a corresponding coin tube. For example, a distance between an inlet of the first channel 542A to the first coin tube 230A is greater than a distance between an inlet of the second channel 542B and the second coin tube 230B. As such, a length of the first channel 542A is greater than a length of the second channel 542B. Generally, the outer channels may comprise a length greater than interior channels.

In one example, the plurality of channels 542 are positioned above the plurality of coin tubes 230. Furthermore, the plurality of channels 542 may be spaced away from the plurality of coin tubes 230 such that the plurality of channels 542 and the plurality of coin tubes 230 do not touch one another. In this way, the outlet manifold 540 may comprise a free flowing configuration, wherein coins dispensed from the outlet manifold 540 to the coin tubes 230 free fall via gravity into a corresponding inlet of the plurality of coin tubes 230. In one example, the outlets of the plurality of channels 542 and the inlets of the coin tubes 230 share common axes extending through geometric centers of both, wherein the common axes may be parallel to gravity 399. As will be described in greater detail below, the plurality of coin tubes 230 may be oriented at an angle such that a trajectory of the coin is adjusted after its free fall from the outlet manifold 540 to the plurality of coin tubes 230.

Turning now to FIG. 7, it illustrates a detailed view 700 of an interaction between an outlet 742 of the first channel 542A and an inlet 730 of the first coin tube 230A. The inlet 730 may comprise a first rim 732. The first rim 732 may comprise an elongated shape relative to a circular shape of the outlet 742. In one example, the first rim 732 comprises an elliptical shape. The first rim 732 may be oriented similarly to the outlet 742 such that a coin free falling from the outlet 742 to the inlet 730 may maintain its direction of travel as it enters the first rim 732. As illustrated, an axis 790 represents a direction of travel of a coin being dispensed from the outlet 742 to the inlet 730 and through the first rim 732. The axis 790 may pass through geometric centers of the outlet 742 and the first rim 732. Additionally or alternatively, the axis 790 may pass through a geometric center of only one of the outlet 742 and the first rim 732. By configuring the coin tube inlet in this way, a likelihood of a jam occurring or a coin missing the inlet 730 is reduced.

The inlet 730 further comprises a second rim 734. It will be appreciated that the first rim 732 and the second rim 734 may be a single, continuous piece in shape of an inlet collar of the inlet 730. The second rim 734 may be oriented at an angle 794 measured between an axis 792 and the axis 790. The axis 792 corresponds to an orientation of the first tube 230A downstream of the first rim 732 relative to a direction of coin travel. In one example, a coin wrapper arranged within the coin tube 230A is only oriented at the angle 794 such that the axis 792 corresponds with the orientation of the coin wrapper. Thus, as a coin passes from the first rim 732 to the second rim 734, the direction of the coin may change from a direction substantially parallel to gravity to a direction parallel to the angle 794.

The angle 794 may be less than 60 degrees. Additionally or alternatively, the angle is less than 50 degrees. Additionally or alternatively, the angle is less than 40 degrees. Additionally or alternatively, the angle is less than 30 degrees. Additionally or alternatively, the angle 794 is less than 20 degrees. Additionally or alternatively, the angle 794 is less than 10 degrees. In one example, the angle is equal to exactly 45 degrees. The angle 794 may be adjusted based on a variety of factors including but not limited to coin size, coin weight, and the like. Additionally or alternatively, the angle 794 may be uniform for all the coin tubes independent of coin denomination.

The angle 794 may be configured to allow a coin wrapper to be inserted into the coin tube 230A without moving the coin tube. Furthermore, due to the deformable configuration of an empty coin wrapper, which comprises paper, the angle 794 may be configured to allow coins to enter the coin wrapper without deforming the coin wrapper (e.g., degrading the coin wrapper via a rip or bend). In one example, deforming the coin wrapper may block subsequent coins from entering the coin wrapper and filling its interior volume.

In this way, the inlet 730 is configured to receive a coin in a first direction parallel to gravity and redirect the coin to move in a second direction angled to gravity (e.g., equal to the angle 794).

Turning now to FIGS. 8A and 8B, they show a side-on view 800 and a face-on view 850 of a coin tube platform 810. In one example, the coin tube platform 810 may be a non-limiting example of a mount of the plurality of mounts 220 of FIG. 2. The coin tube platform 810 may be a stationary component arranged in one of the plurality of slots of the coin sorting apparatus. The coin tube platform 810 comprises an angled surface 820 configured to receive a coin tube. As such, the angled surface 820 may be angled at an angle similar to angle 794 of FIG. 7.

The angled surface 820 is coupled to a base 822 and a top 824. The base 822 and the top 824 may be parallel to one another. An opposite surface 826 may be coupled to the base 822 and the top 824, wherein the opposite surface 826 is opposite to the angled surface 820. The opposite surface 826 may be oriented perpendicularly to the base 822 and the top 824. In this way, the coin tube platform 810 may resemble a triangle.

The angled surface 820 comprises one or more features for receiving a coin tube. For example, the angled surface 820 comprises a recess 852 extending from a middle portion of the angled surface 820 to the top 824. The recess 852 may comprise a linear shape (e.g., a rectangle shape), wherein a cross-section of the recess 852 may comprise a square shape. The recess 852 may be shaped to receive a protrusion of the coin tube, which may position the coin tube desirably below the outlet manifold so that a coin wrapper on the coin tube may receive dispensed coins without jamming.

The angled surface 820 further comprises a cutout 854. A cross-section of the cutout 854 may comprise a circular shape, wherein a diameter of the circular shape may be less than a width of the angled surface. The cutout 854 may be shaped to receive a lower portion (e.g., a bottom) of a coin tube. The cutout 854, in combination with the recess 852, may block movement of the coin tube due to coins being dispensed and/or the coin wrapper being removed. In this way, the coin tube may not be unintentionally removed from the coin tube platform 810 with a deliberate upward force applied against the coin tube.

Turning now to FIGS. 9A, 9B, and 9C, they show a side-on view 900, a face-on view 925, and a top-down view 950 of the first coin tube 230A, respectively. A protrusion 902 of the first coin tube 230A is illustrated in the side-on view 900. The protrusion 902 is shaped to be seated within the recess of the coin tube platform (e.g., recess 852 of coin tube platform 810 of FIG. 8B). The protrusion 902 may rest within the recess when the first coin tube 230A is positioned desirably into the first slot.

The coin tube 230A further comprises a bottom 904, wherein the bottom is configured to rest within the cutout (e.g., cutout 854 of FIG. 8B). The bottom 904 may be shaped to be in face-sharing contact with surfaces of the cutout. Thus, a combination of the bottom 904 engaging with the cutout and the protrusion 902 engaging with the recess may block the first coin tube 230A from moving when coins are dispensed or when a coin wrapper is removed.

As illustrated in FIGS. 9A and 9B, the first coin tube 230A comprises a cylindrical shape, wherein a longitudinal section of the cylinder is cutout. The coin wrapper may be positioned in this cutout, as illustrated via dotted box 906, wherein a top of the coin wrapper is below the second rim 734 and a bottom of the coin wrapper is in face-sharing contact with the bottom 904. In some examples, the coin wrapper may be positioned such that the top of the coin wrapper is engaged with second rim 734 (e.g., positioned within an opening of the second rim 734) and seated against the bottom 904 and resting on a body 905 of the first coin tube 230A.

The top-down view 950 illustrates a difference in diameter of the first rim 732 and the second rim 734. The first rim 732 may comprise a first diameter 952 and the second rim 734 may comprise a second diameter 954. The first diameter 952 may be larger than the second diameter 954. In one example, the first diameter 952 is 1.2 times, 1.5 times, 2.0 times or more, larger than the second diameter 954. The first diameter 952 may be larger to increase an accuracy of dispensed coins entering the first coin tube 230A. The second diameter 954 may be smaller to align the coin as it falls and enters a coin wrapper arranged on the first coin tube 230A. The diameter of the first coin tube 230A may gradually decrease from the first diameter 952 to the second diameter 954.

Turning now to FIG. 10, it shows an embodiment 1000 of the coin sorting apparatus 200, wherein a base 1002 of the coin sorting apparatus 200 is exposed. A plurality of slots 1020 comprises a first slot 1020A, a second slot 1020B, a third slot 1020C, and a fourth slot 1020D. In one example, the plurality of slots 1020 may be a non-limiting example of the plurality of slots 120 of FIG. 1. The plurality of slots 1020 comprises a first slot 1020A, a second slot 1020B, a third slot 1020C, and a fourth slot 1020D. Each of the plurality of slots 1020 comprises at least one magnet of a plurality of magnets 1022. In the example of FIG. 10, each slot comprises only one magnet such that the first slot 1020A comprises a first magnet 1022A, the second slot 1020B comprises a second magnet 1022B, the third slot 1020C comprises a third magnet 1022C, and the fourth slot 1020D comprises a fourth magnet 1022D. Each of the magnets of the plurality of magnets 1022 may be arranged along a common axis 1099, which is parallel to the x-axis. Additionally, a positioning of each magnet within each corresponding slot on the base 1002 may be along a central axis of each slot. That is to say, the plurality of magnets 1022 may be positioned along centers of the plurality of slots 1020 such that a coin bin or a coin tube arranged in a slot may engage with the magnet and be centered within the slot to receive coins from an outlet manifold (e.g., outlet manifold 540 of FIG. 5).

Turning now to FIGS. 11 and 12, they show a first view 1100 and a second view 1200 of a plurality of bins 1110 and a coin tube 1130 arranged on a coin tube platform 1120. The coin tube 1130 may be a non-limiting example of a coin tube of the plurality of coin tubes 230 of FIG. 2. Similarly, the coin tube platform 1120 may be a non-limiting example of a coin tube platform of the plurality of coin tube platforms 220 of FIG. 2.

The plurality of bins 1110 comprise a plurality of magnets 1112. More specifically, the plurality of bins 1110 comprises a first bin 1110A and a first bin magnet 1112A, a second bin 1110B and a second bin magnet 1112B, and a third bin 1110C and a third bin magnet 1112C. Each of the magnets may be arranged along a corresponding central axis of each of the bins of the plurality of bins.

In the example of FIGS. 11 and 12, the plurality of magnets 1112 are biased toward a front face 1114 of the plurality of bins 1110, wherein the front 1114 is an exposed face of the plurality of bins 1110 when the bin magnets are engaged with the plurality of magnets of the coin sorting apparatus (e.g., plurality of magnets 1022 of the coin sorting apparatus 200 of FIG. 10).

Similarly, the coin tube platform 1120 comprises a magnet 1122 arranged at a base 1124. Although only one coin tube platform is illustrated in the examples of FIGS. 11 and 12, it will be appreciated that a plurality of coin tube platforms may be identical to the coin tube platform 1120 and comprise a plurality of magnets similar to the magnet 1122.

The coin tube platform 1120 is rotated to an orientation normal to its orientation when positioned in the coin sorting apparatus in the embodiment of FIGS. 11 and 12 for reasons of clarity. However, when arranged in the coin sorting apparatus, the magnet 1122 may align with the plurality of magnets 1112 along a single common axis, which may be identical to the common axis 1099 of FIG. 10.

While the embodiments of FIGS. 10, 11, and 12 illustrate a magnetic coupling between a single magnet of the base and a single magnet of either the coin tube platform (e.g., a mount) or the bin, it will be appreciated that other numbers of magnets and positioning of the magnets may be used. For example, two or more magnets may be arranged on the base of the coin sorting apparatus along with a corresponding two magnets on either the coin tube platform or the bin. The magnets may be arranged along the common axis or along a central axis of the slot. In some examples, three or more magnets may be symmetrically arranged on the base and on either the coin tube platform or the bin. A magnetic coupling strength of the single magnets or of the multiple magnets may be equal, wherein the magnetic coupling strength allows the components to be retained within the coin sorting apparatus while coins are dispensed and allows for quick removal of the coin tube platform or the bin.

Thus, each of the coin sorting apparatus and the coin tube platforms and bins comprise magnets, wherein magnets of the coin sorting apparatus are configured to magnetically couple to magnets of the coin tube platforms and of the bins. The magnets may retain the coin tube platforms and bins within the coin sorting apparatus at a desired position to enable coin wrappers and the bins to receive coins from an outlet manifold at a desired angle. As coins are dispensed, the magnetic coupling between the magnets retains the bins and coin tube platforms in place despite a force of the coins falling from the outlet manifold and into the bins or coin wrappers. A user may remove the bins by applying a force greater than the magnetic coupling. However, the user may freely remove the coin wrappers without overcoming the magnetic coupling as the coin wrappers, and the coin tubes, are not held in place via the magnetic coupling.

In this way, a coin sorting apparatus may increase efficiency and simplify its operation via providing a coin tube configured to receive and release a coin wrapper without moving. The technical effect of arranging the coin wrapper onto the coin tube and removing the coin wrapper from the coin tube without moving the coin tube is to accelerate dispensing coins into a plurality of coin wrappers. Furthermore, removing and arranging the coin wrapper in previous examples is difficult due to a flexibility of the coin wrapper when empty and a rigidity of the coin wrapper when filled. However, in the present disclosure, the coin wrapper is easily placed and removed from the coin tube independent of a fill state of the coin wrapper.

An embodiment of a system, comprises a coin sorting apparatus configured to receive a coin wrapper without moving a coin tube.

A first example of the system further includes where the coin wrapper is positioned within a partial cutout of the coin tube.

A second example of the system, optionally including the first example, further includes where the coin wrapper is positioned at an angle relative to a direction of travel of a coin being dispensed to the coin tube.

A third example of the system, optionally including one or more of the previous examples, further includes where the angle is between 40 to 50 degrees.

A fourth example of the system, optionally including one or more of the previous examples, further includes where the coin wrapper is less rigid than the coin tube.

A fifth example of the system, optionally including one or more of the previous examples, further includes where the coin tube comprises an inlet comprising a first rim and a second rim, wherein the first rim is positioned below an outlet of an outlet manifold and configured to receive a coin free falling from the outlet.

A sixth example of the system, optionally including one or more of the previous examples, further includes where the second rim is configured to align the coin with the coin wrapper.

A seventh example of the system, optionally including one or more of the previous examples, further includes where a first rim diameter is greater than a second rim diameter.

An embodiment of a coin sorting apparatus, comprises a mount comprising an angled surface with a recess and a cutout, a coin tube comprising a protrusion configured to engage with the recess and a bottom configured to engaged with the cutout, and a coin wrapper configured to rest against a body of the coin tube.

A first example of the coin sorting apparatus further comprises wherein the coin tube comprises a cylindrical shape, and wherein a longitudinal surface of the coin tube is cutout and shaped to receive the coin wrapper.

A second example of the coin sorting apparatus, optionally including the first example, further includes where an outlet manifold comprising at least one channel positioned above the coin tube, wherein the at least one channel is spaced away from an inlet of the coin tube and configured to dispense a coin into the inlet of the coin tube.

A third example of the coin sorting apparatus, optionally including one or more of the previous examples, further includes where the inlet of the coin tube is misaligned with an inlet of the coin wrapper.

A fourth example of the coin sorting apparatus, optionally including one or more of the previous examples, further includes where the coin wrapper is only partially surrounded by the coin tube.

A fifth example of the coin sorting apparatus, optionally including one or more of the previous examples, further includes where half or less of the coin wrapper is surrounded by the coin tube.

A sixth example of the coin sorting apparatus, optionally including one or more of the previous examples, further includes where the coin wrapper is configured to rest against the body of the coin tube without moving the coin tube, further comprising where the coin wrapper is configured to move away from the coin tube without moving the coin tube.

An embodiment of a system comprises a coin sorting apparatus comprising a plurality of coin tubes arranged on a plurality of mounts, wherein the plurality of mounts are magnetically coupled to a base of the coin sorting apparatus, each coin tube of the plurality of coin tubes comprises a coin wrapper arranged thereon, the coin wrapper is configured to receive a coin dispensed from an outlet manifold in a first direction parallel to gravity and redirect the coin in a second direction at an angle to gravity, wherein the plurality of coin tubes is configured to receive and release the coin wrapper of a plurality of coin wrappers without being moved.

A first example of the system further includes where the coin tube comprises an inlet comprising a first rim and a second rim, wherein the first rim is upstream of the second rim with respect to a direction of coin movement, wherein the first rim receives the coin dispensed from the outlet manifold and the second rim redirects the coin into the coin wrapper, wherein only the plurality of mounts is magnetically or mechanically coupled to the base, and wherein each of the plurality of coin tubes and the coin wrapper are removeable from the plurality of mounts without removing the plurality of mounts from the coin sorting apparatus.

A second example of the system, optionally including the first example, further includes where the coin wrapper is positioned below a lowest portion of the second rim, and wherein magnets of the plurality of mounts are biased toward a front edge of the plurality of mounts, wherein the front edge is an exposed edge and visible when a mount is arranged in the coin sorting apparatus.

A third example of the system, optionally including one or more of the previous examples, further includes where the outlet manifold is positioned above the plurality of coin tubes, further comprising where coins dispensed from the outlet manifold free fall into the coin wrapper, further comprising a bin configured to capture coins, wherein the bin is configured to magnetically or mechanically couple to the base of the coin sorting apparatus without the plurality of mounts and the plurality of coin tubes.

A fourth example of the system, optionally including one or more of the previous examples, further includes where a coin tube of the plurality of coin tubes is stationary when a coin wrapper is positioned on or removed from the coin tube.

It will be appreciated that the configurations and routines disclosed herein are exemplary in nature, and that these specific embodiments are not to be considered in a limiting sense, because numerous variations are possible. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first"

element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A coin sorting apparatus, comprising:

a mount comprising an angled surface with a recess and a cutout;

a coin tube comprising a protrusion configured to engage with the recess and a bottom configured to engaged with the cutout; and a coin wrapper configured to rest against a body of the coin tube, wherein the coin wrapper is positioned within a partial cutout of the coin tube, wherein the mount is magnetically coupled to a base of the coin sorting apparatus, the base supporting the mount from below with respect to gravity, and wherein a cross-section of the cutout of the mount is a circular shape, wherein a diameter of the circular shape is less than a width of the angled surface, and wherein the cutout is shaped to receive a lower portion of the coin tube, wherein the angled surface supports the coin tube from below with respect to gravity.

2. The coin sorting apparatus of claim 1, wherein the coin tube comprises a cylindrical shape, and wherein a longitudinal surface of the coin tube is cutout and shaped to receive the coin wrapper, the coin sorting apparatus configured to receive the coin wrapper without moving the coin tube.

3. The coin sorting apparatus of claim 1, further comprising an outlet manifold comprising at least one channel positioned above the coin tube, wherein the at least one channel is spaced away from an inlet of the coin tube and configured to dispense a coin into the inlet of the coin tube.

4. The coin sorting apparatus of claim 3, wherein the inlet of the coin tube is misaligned with an inlet of the coin wrapper.

5. The coin sorting apparatus of claim 1, wherein the coin wrapper is only partially surrounded by the coin tube.

6. The coin sorting apparatus of claim 5, wherein half or less of the coin wrapper is surrounded by the coin tube.

7. The coin sorting apparatus of claim 1, wherein the coin wrapper is configured to rest against the body of the coin tube without moving the coin tube, further comprising where the coin wrapper is configured to move away from the coin tube without moving the coin tube.

8. A system, comprising:

a coin sorting apparatus comprising a plurality of coin tubes arranged on a plurality of mounts, wherein the plurality of mounts are magnetically coupled to a base of the coin sorting apparatus, each coin tube of the plurality of coin tubes comprises a coin wrapper arranged thereon, the coin wrapper is configured to receive a coin dispensed from an outlet manifold in a first direction parallel to gravity and redirect the coin in a second direction at an angle to gravity, wherein the plurality of coin tubes is configured to receive and release the coin wrapper of a plurality of coin wrappers without being moved, wherein the coin wrapper is positioned within a partial cutout of the coin tube, wherein the coin tube has a cylindrical body of fixed diameter along a longitudinal length, and wherein the partial cutout is of the cylindrical body such that cylindrical walls of the cylindrical body at the partial cutout surround only a portion of the coin wrapper, and wherein cylindrical surfaces of the coin wrapper are in face-sharing contact with the walls of the cylindrical body longitudinally along an entirety of the partial cutout, the base supporting the mount from below with respect to gravity, and wherein a cross-section of the cutout of the mount is a circular shape, wherein a diameter of the circular shape is less than a width of the angled surface, and wherein the cutout is shaped to receive a lower portion of the coin tube, wherein the angled surface supports the coin tube from below with respect to gravity.

9. The system of claim 8, wherein the coin tube comprises an inlet comprising a first rim and a second rim, wherein the first rim is upstream of the second rim with respect to a direction of coin movement, wherein the first rim receives the coin dispensed from the outlet manifold and the second rim redirects the coin into the coin wrapper, wherein only the plurality of mounts is magnetically coupled to the base, and wherein each of the plurality of coin tubes and the coin wrapper are removable from the plurality of mounts without removing the plurality of mounts from the coin sorting apparatus, wherein each of the plurality of mounts is triangular.

10. The system of claim 9, wherein the coin wrapper is positioned below a lowest portion of the second rim, and wherein magnets of the plurality of mounts are biased toward a front edge of the plurality of mounts, wherein the front edge is an exposed edge and visible when a mount is arranged in the coin sorting apparatus.

11. The system of claim 8, wherein the outlet manifold is positioned above the plurality of coin tubes, further comprising where coins dispensed from the outlet manifold free fall into the coin wrapper, further comprising a bin configured to capture coins, wherein the bin is configured to magnetically couple to the base of the coin sorting apparatus without the plurality of mounts and the plurality of coin tubes.

12. The system of claim 8, wherein each coin tube of the plurality of coin tubes is stationary when a coin wrapper is positioned on or removed from any of the coin tubes.

* * * * *